US006854138B2

(12) United States Patent
Xu

(10) Patent No.: US 6,854,138 B2
(45) Date of Patent: Feb. 15, 2005

(54) CRIB ROCKING MECHANISM WITH LOCK

(76) Inventor: Jim Xu, 24 Willow Bay Dr., South Barrington, IL (US) 60010

( * ) Notice: Subject to any disclaimer, the term of this patent is extended or adjusted under 35 U.S.C. 154(b) by 0 days.

(21) Appl. No.: 10/137,742

(22) Filed: May 2, 2002

(65) Prior Publication Data

US 2003/0204907 A1 Nov. 6, 2003

(51) Int. Cl.[7] ..... A47D 9/02

(52) U.S. Cl. ..... 5/106; 5/109; 70/269; 70/271

(58) Field of Search ..... 5/101–109; 70/267, 70/268, 269, 271

(56) References Cited

U.S. PATENT DOCUMENTS 2,493,655 A 1/1950 Chodacki et al.
2,765,478 A 10/1956 Pinto
3,031,686 A 5/1962 Muzzey
4,881,285 A 11/1989 Zeeb
5,048,135 A 9/1991 Chen
5,107,555 A 4/1992 Thrasher
5,711,045 A 1/1998 Caster et al.

*Primary Examiner*—Alexander Grosz

(57) ABSTRACT

A rocking crib or cradle having a motion inducing mechanism with automatic lock. The motion inducing mechanism imparts a movement to a movable portion of the crib or cradle in relation to a longitudinal base while the lock immobilizes the movable portion in relation to the base. Operation of both the motion inducing mechanism and lock are related to one another with a timer such that the lock automatically immobilizes the movable portion of the crib when the time duration of the motion inducing mechanism is expended. A time delay switch may be connected between the timer and lock to delay operation of the lock for a preset time after the expiration of the time duration of the motion inducing mechanism. A handle may be connected to the lock to manually operate the lock to immobilize or free the movable portion of the crib in relation to the longitudinal base, such manual operation energizing or de-energizing the timer and motion inducing device accordingly.

15 Claims, 13 Drawing Sheets

CRIB ROCKING MECHANISM WITH LOCK

FIELD OF THE INVENTION

The present invention relates to a cradle assembly that includes a rockable portion, and a rocking and locking subassembly for the rockable portion.

BACKGROUND OF THE INVENTION

Rocking cradles and cribs have been utilized for centuries to calm and soothe babies and to assist them in falling asleep. Rocking cradles and cribs evidently originally incorporated arcuate floor-engaging support members located at bottom opposite ends of a cradle or crib to achieve the desired rocking motion.

Among the prior art cradle and crib structures, Zeeb U.S. Pat. No. 4,881,285 discloses a cradle that is suspended for rocking by linkages from an associated base and that is rocked by a drive motor through a crank. In prior art powered rocking cribs and cradles, typically, the drive motor, when energized, produces a constant rocking movement of a movable or rocking portion.

Pinto U.S. Pat. No. 2,765,478 discloses a motorized rocking crib that incorporates a timing device therein which enables the motorized crib to rock for a pre-selected time interval.

In a powered rocking crib or cradle, it would be desirable to allow an individual to immobilize the movable portion of the crib or cradle against further rocking movement. Immobilization would allow the individual to tend to the baby lying therein without displacing or moving the movable portion. For example, movement of the movable portion of the crib or cradle is undesirable when attempting to change a baby's diaper while the baby is lying therein.

A disadvantage of prior crib or cradle structures is that they incorporate powered motion inducing devices that are not related to locking devices. For example, a need existed to manually lock the movable portion which required additional time and effort when such time and effort would be better spent in caring for the baby.

Thus, there is a need for an improved apparatus and method that induces a rocking motion in a movable portion of a rocking cradle assembly and thereafter automatically locks the movable portion against further movement upon the expiration of the time interval of operation of the incorporated motion inducing mechanism.

SUMMARY OF THE INVENTION

The present invention provides a novel and improved rocking cradle assembly that incorporates both a rockable subassembly for an associatable crib and also a rocking and locking subassembly for the rockable subassembly.

The inventive cradle assembly reduces the foregoing disadvantages associated with the prior art and provides advantages in construction, mode of operation and use.

In a preferred form, the rocking cradle with motion inducing mechanism and lock device incorporates a longitudinal base having a movable rocking portion movably attached thereto. The longitudinal base has a rectangular footprint and includes a pair of spaced, parallel, lengthwise extending base supports that are located on opposite sides of the footprint. The lengthwise base supports are of equal length and are secured to one another with a pair of spaced, parallel, widthwise extending bottom cross struts, also of equal length.

Extending upwardly from each of the two base supports of the longitudinal base are a plurality of vertical base brackets, preferably three per base support, that are oriented parallel to one another. The vertical base brackets each extend upwardly from each base support an equal height. At the top of each set base brackets for each base support a lengthwise top support is provided that is oriented parallel to, and has the same length as, each respective base support. The lengthwise extending top supports, which comprise the pair, are also of equal length, and this pair is secured together by a pair of spaced, parallel, widthwise extending top cross struts, also of equal length.

The movable portion of the cradle assembly incorporates two spaced, parallel, lengthwise extending bottom beams that are secured to one another by two cross-wise extending cross members which are oriented preferably perpendicularly to the bottom beams.

The movable portion of the cradle assembly is suspended by hanging links from the top supports of the base. The top of each hanging link is pivotally connected to a different opposite end of each top support of the longitudinal base while the bottom of each hanging link is pivotally connected to a different opposite end of each lengthwise bottom beam of the movable portion. The resulting arrangement provides a four-link suspension that enables the moving or rocking portion to swing (rock) longitudinally generally parallel relative to the longitudinal base.

Extending upwardly from each lengthwise bottom beam of the movable portion are four vertical carriage brackets. The four vertical carriage brackets on each lengthwise bottom beam are of equal length, with each vertical carriage bracket positioned vertically parallel to one another. Connected at the top of each set of four vertical carriage brackets is a lengthwise top beam. The two lengthwise top beams, parallel to one another, are secured to one another with two widthwise top cross strut members that are preferably perpendicular to the top beams.

The height of the two lengthwise extending top beams and two widthwise extending top cross strut members of the movable portion are located preferably vertically above the two lengthwise top supports of the longitudinal base. Because the lengthwise extending top beams are rigidly connected to the lengthwise bottom beams by means of the eight vertical carriage brackets, the top beams swing with the bottom beams longitudinally parallel to the longitudinal base via the four hanging links.

The lengthwise top beams and the widthwise top cross members of the movable portion, as located vertically above the lengthwise top supports of the longitudinal base, constitute a swinging platform upon which a crib can rest. In the presently preferred embodiment of the invention, the crib comprises a child's bedstead, with high enclosing or slatted sides surrounding a mattress or other padding. However, it is understood that other constructions for the crib may be employed, if desired.

Affixed to the longitudinal base is a housing having a motion inducing mechanism enclosed therein. The motion inducing mechanism on the longitudinal base operably engages the movable portion of the cradle assembly functions to induce and maintain a movement or motion of the movable portion when the motion inducing mechanism is energized.

A user adjustable timer is in operative association with the motion inducing mechanism and the timer functions to control the time interval during which the motion inducing mechanism is energized and operates.

A lock device is also affixed to the longitudinal base. Actuation and operation of the lock device is regulated by the timer with which the lock device is associated. The lock device functions to fix the position of the movable portion of the cradle assembly relative to the longitudinal base when the time interval of operation set into the timer has expired.

In one embodiment of the invention, the lock device is functionally connected to the timer via a delay switch. The delay switch, in response to the timer, becomes energized when the time interval of operation set into the timer has expired. After a preselected delay time interval associated with the energized delay switch has passed, the delay switch operates (closes) and triggers the lock device to actuate, thus immobilizing the movable portion of the cradle assembly in relation to the longitudinal base.

In another embodiment of the invention, the lock device includes a handle that is movable to manually engage and disengage the lock device between the longitudinal base and movable portion of the cradle assembly. Operation of the handle also causes de-energization by the timer and stopping of the motion inducing mechanism or device when the lock device engages the movable portion.

In operation of one embodiment of the invention, the timer is set by the user to a time interval that preferably extends from about one minute to about sixty minutes. Upon the setting of the timer, the motion inducing device is energized, thus inducing a rocking movement in the movable portion of the cradle assembly. Upon an expiration of the time interval set into the timer, the motion inducing device is de-energized and the lock device is energized. This energization causes the lock device to operate and to engage the movable portion, thus immobilizing it in relation to the longitudinal base.

In operation of another embodiment of the invention, the timer is set to any time duration preferably ranging from about one minute to about sixty minutes. Upon the setting of the timer, the motion inducing device is energized, thus inducing a rocking movement in the movable portion. Upon expiration of the set time interval, the timer functions to de-energize the motion inducing device and to energize the delay switch. After expiration of the preselected delay time interval of the energized delay switch, the delay switch triggers the lock device to actuate, thus immobilizing the movable portion.

In operation of yet another embodiment of the invention, the handle associated with the lock device is manually moved to a lock disengaged position, thus disconnecting the immobilizing connection existing between the longitudinal base and the movable portion and optionally energizing the timer. The timer is then settable to a desired time duration interval preferably in the range of from about one minute to about sixty minutes. Upon setting the timer, the motion inducing device is energized, thus inducing a rocking movement in the movable portion of the crib. Upon expiration of the set time interval of the timer operation, the motion inducing device is de-energized and the delay switch is energized. After a preselected delay time interval associated with the energized delay switch, the delay switch triggers the lock to actuate, thus immobilizing the movable portion in relation to the longitudinal base.

Other and further objects, aims, features, advantages, embodiments and the like will be apparent to those skilled in the art from the present specification taken with the accompanying drawings and the appended claims.

DETAILED DESCRIPTION

Figure 1:
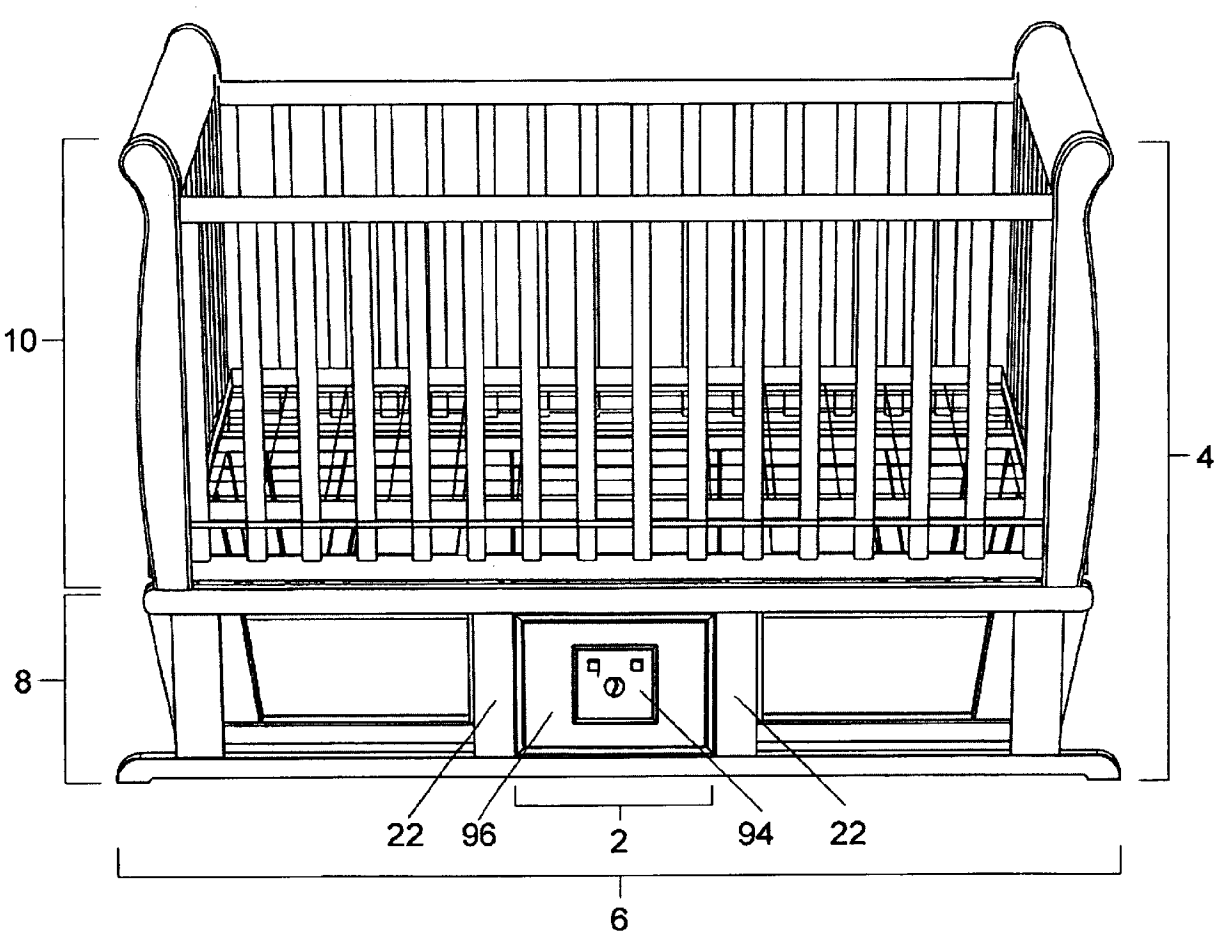
FIG. 1 is a perspective view of one embodiment of a cradle assembly of the invention that includes a movable crib rocking subassembly and a powered crib rocking and locking subassembly.

Referring to FIG. 1, there is seen an embodiment of a cradle assembly 4 that includes a longitudinally elongated base 6, a movable rocking portion 8, a separatable crib or bedstead 10, and a rocking and locking mechanism 2. The bedstead 10 holds a mattress, or other padding (not shown) for a baby or infant, rests on or is affixed to the movable portion 8. The movable portion 8 of the rocking crib or cradle 4 is movably mounted to the longitudinal base 6. The rocking and locking mechanism 2 is both fixedly mounted to the longitudinal base 6 and movably connected to the movable portion 8.

Crib rocking and locking mechanism is electrically energized and operates to both impart a rocking motion to the movable portion 8 of the cradle assembly 4 for a preselected time duration, and also automatically lock or immobilize the movable portion 8 in relation to the longitudinal base 6 of the cradle assembly 4 when the duration of a preselected time interval for the rocking motion of movable portion 8 has expired. Details regarding the construction and operation of the crib rocking and locking mechanism 2 are provided below.

Figure 2:
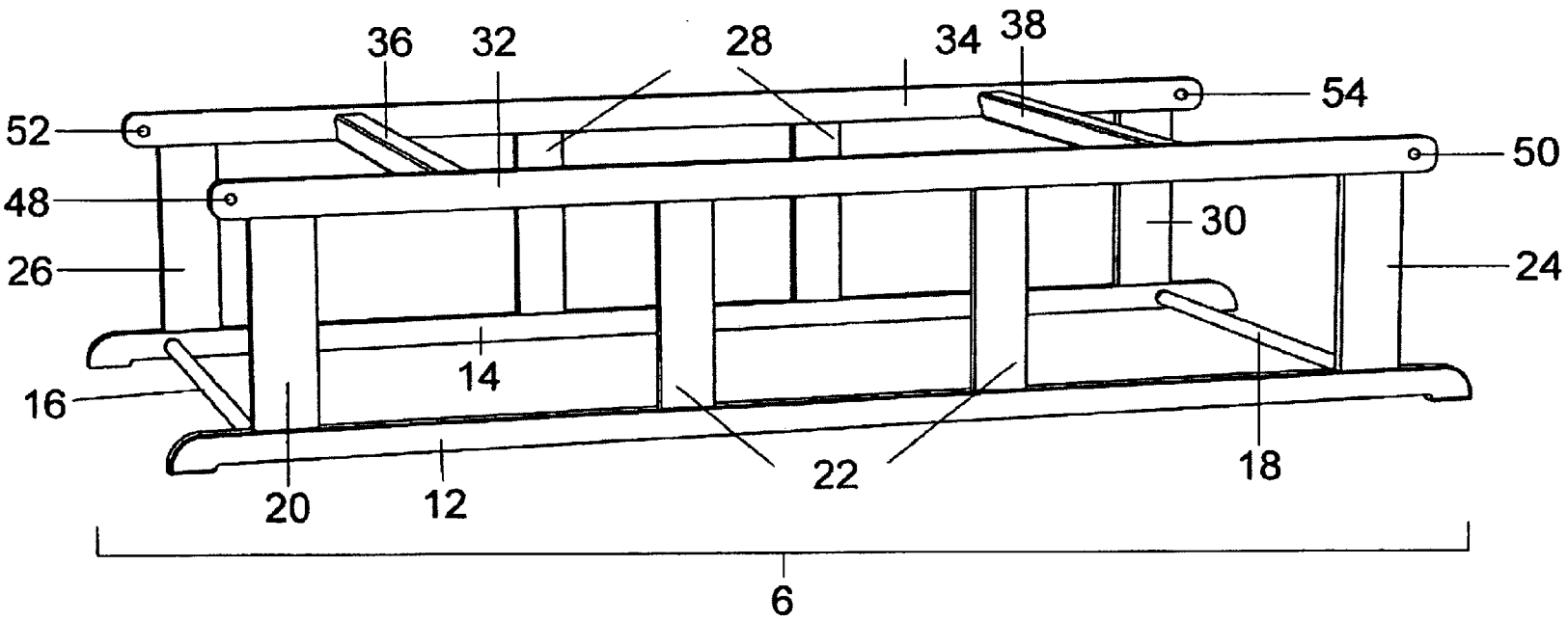
FIG. 2 is a perspective view of the longitudinal base and hanging links of the cradle assembly.

In FIG. 2, the longitudinal extending base 6 of the cradle assembly 4 is shown without the movable portion 8 and the bedstead 10 attached thereto.

Base 6 can be constructed of wood, metal, plastic or any other material capable of maintaining structural rigidity. Base 6 preferably has, as shown, a generally rectangular footprint and includes a pair of laterally spaced, parallel, lengthwise extending base supports 12 and 14, each one located on a different opposite side of the base 6. The base supports 12 and 14 are of equal length and are secured to one another with a pair of longitudinally spaced, parallel, widthwise extending, bottom cross struts 16 and 18, each of equal length.

Extending upwardly from each of the two lengthwise base supports 12 and 14 are three vertical base support brackets 20, 22 and 24, and 26, 28 and 30, respectively. Vertical base brackets 20, 22 and 24, and 26, 28 and 30 are oriented so as to be laterally parallel to one another and perpendicular to the respective base supports 12 and 14. The vertical base brackets 20, 22 and 24, and 26, 28 and 30 extend upwardly from respective lengthwise base supports 12 and 14 and are of equal height. At the top of each set of three base brackets 20, 22 and 24, and 26, 28 and 30 are respective lengthwise extending top supports 32 and 34 that are oriented in laterally spaced, parallel relationship to one another. Lengthwise extending top supports 32 and 34, line base supports 12 and 14, are of equal length relative to each other. The lengthwise top supports 32 and 34 comprising the pair are secured together by a pair of spaced, parallel, widthwise extending, top cross struts 36 and 38, that are of equal length relative to each other similar to bottom cross struts 16 and 18.

Connected to the respective opposite ends of each top support 32 and 34 is a hanging links 40 and 42, and 44 and 46, respectively. Hanging links 40, 42, 44 and 46 can be constructed of wood, metal, plastic or any other material capable of maintaining tension. The top portion of each hanging links 40, 42, 44 and 46 is connected to a different end of lengthwise supports 32 and 34 with respective top pins 48, 50, 52 and 54. The connection of the top portion of each hanging links 40, 42, 44 and 46 to a different ends of top supports 32 and 34 with top pins 48, 50, 52 and 54 facilitates a connection between the links and supports that allows each link 40, 42, 44, and 46 to swing about a transversely extending axis defined by each associated pin so that the links each longitudinally swing parallel (lengthwise) with the base 6. Although hanging links 40, 42, 44 and 46 are connected to lengthwise top supports 32 and 34 with respective top pins 48, 50, 52 and 54, it is understood that the hanging links can be connected to lengthwise supports with other means that facilitates the desired swinging or pivotal connection.

Figure 3:
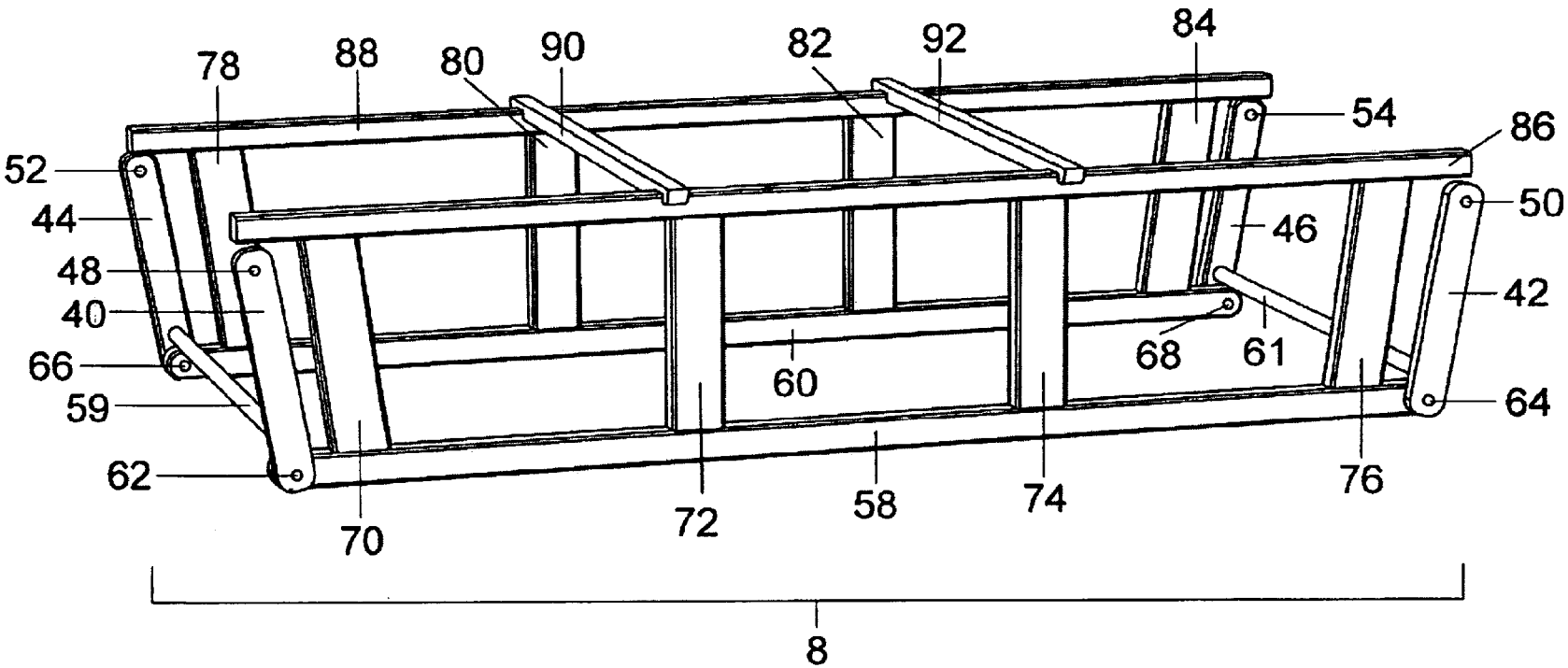
FIG. 3 is a perspective view of the movable portion of the cradle assembly.

Connected at the respective bottoms of hanging links 40, 42, 44 and 46 is movable portion 8 of the cradle assembly 4. In FIG. 3, movable portion 8 is shown without hanging links 40, 42, 44, and 46 for clarity. Movable portion 8 can be constructed of wood, metal, plastic or any other material capable of maintaining structural rigidity. Movable portion 8 is connected to the respective bottom portions of each hanging link 40, 42, 44 and 46 at each opposite ends of respective bottom beams 58 and 60 by a bottom pin 62, 64, 66, and 68, respectively. Bottom beams 58 and 60 extend parallel to one another, are of equal length, and are secured to one another by spaced, parallel, widthwise extending bottom cross struts 59 and 61 that are of equal length.

Extending upwardly from each of bottom beams 58 and 60 of the movable portion 8 are four vertical carriage support brackets 70, 72, 74 and 76, and 78, 80, 82 and 84, respectively. The four vertical carriage support brackets on each lengthwise bottom beam are of equal length, with each vertical carriage support bracket being positioned perpendicularly and parallel to the others. Connected at the top of each set of four vertical carriage brackets are respective lengthwise extending, spaced, parallel top beams 86 and 88. Top beams 86 and 88 are of equal length, and are secured to one another by spaced, parallel, widthwise extending top cross struts 90 and 92 that are of equal length. Widthwise extending top cross members 90 and 92 are also of equal length relative to widthwise extending bottom cross members 59 and 61.

Since lengthwise top beams 86 and 88 are rigidly connected to lengthwise bottom beams 58 and 60 with respective vertical carriage support brackets 70, 72, 74 and 76, and 78, 80, 82 and 84, the lengthwise top beams 86 and 88 swing with the lengthwise bottom beams 58 and 60 in a direction that is longitudinally parallel to the longitudinal base 6 through pivoting of the four hanging links 40, 42, 44 and 46.

Figure 4:
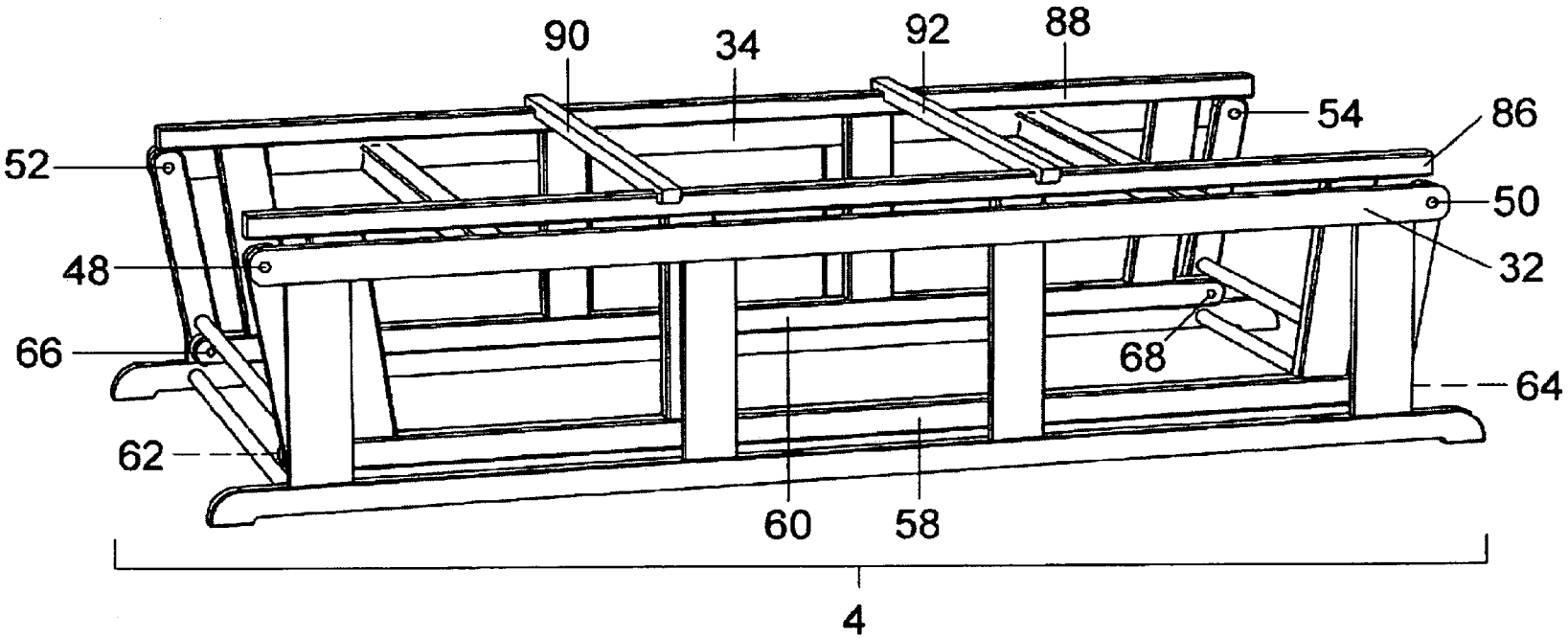
FIG. 4 is a perspective view of the movable portion of the cradle assembly in combination with the longitudinal base but omitting the hanging links for clarity.

In FIG. 4, the movable portion 8 of the cradle assembly 4 is shown located proximal to the longitudinal base 6 as if connected thereto by the hanging links 40, 42, 44 and 46. However, for the sake of clarity, the links themselves have been omitted from FIG. 4. As can be seen in FIG. 4, the top portions of the hanging links 40, 42, 44 and 46 are pivotally connected to the respective ends of each top supports 32 and 34 of the base 6 through the top pins 48, 50, 52 and 54, respectively, while the bottom portions of the hanging links 40, 42, 44 and 46 are pivotally connected to the respective ends of each bottom beam 58 and 60 of the movable portion 8 through the bottom pins 62, 64, 66 and 68, respectively. The mounting movable portion 8 to longitudinal base 6 of cradle assembly 4 constitutes a four-link mechanism that allows movable portion 8 to swing longitudinally parallel (in a lengthwise direction) to the base 6.

The top beams 86 and 88, together with widthwise top cross struts 90 and 92, provide a swinging movable portion 8 upon which the bedstead 10 (FIG. 1) may rest. In the preferred embodiment of the invention, the bedstead 10 includes relatively high enclosing or slatted sides surrounding a mattress or other padding (not shown). However, it is understood that other constructions of the bedstead 10 are possible.

As shown in FIG. 1, the motion inducing mechanism or subassembly 94 and lock subassembly or device 96 of the crib rocking and locking mechanism 2 are fastened to vertical bracket 22 of the stationary base 6 by screws, rivets, or the like (not shown). Alternatively, the motion inducing mechanism 94 and lock device 96 can be affixed to other locations of the base 6, such as to one of the vertical base brackets 20, 24, 26, 28 or 30, as well as to either of lengthwise base supports 12 or 14, or either of lengthwise top supports 32 or 34, or otherwise, as may be desired.

Both the motion inducing mechanism 94 and the lock device 96 are affixed to the longitudinal base 6 and are operably engageable with the movable portion 8. The motion inducing mechanism 94 imparts and sustains a rocking motion of the movable portion 8 in relation to the longitudinal base 6. The lock device 96 immobilizes the movable portion 8 in relation to the longitudinal base 6. The operations of device 96 and mechanism 94 are directly related to one another.

Figure 5:
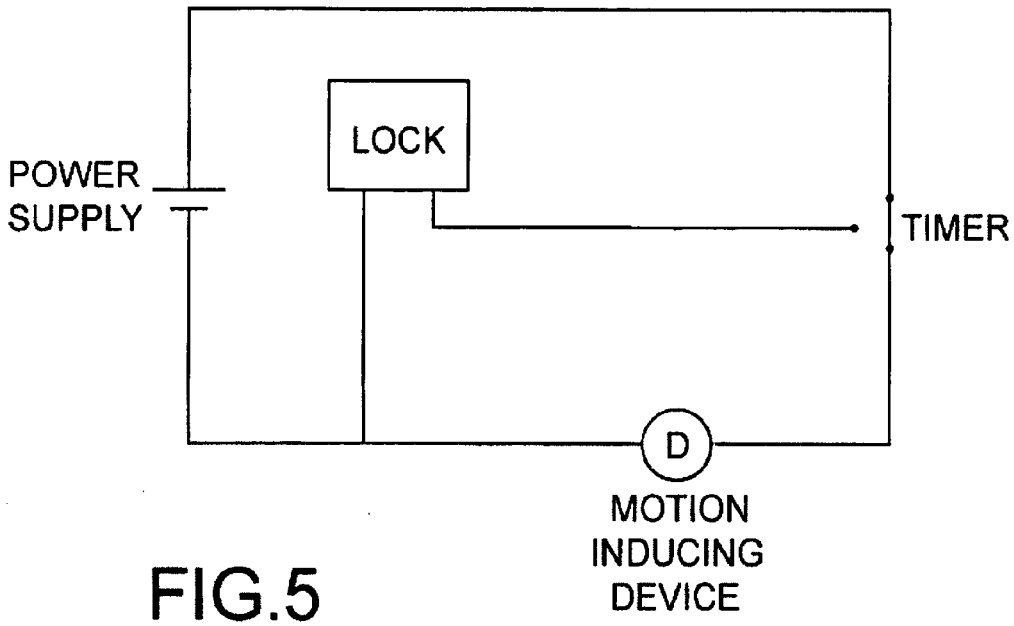
FIG. 5 is a circuit diagram of one embodiment of a combined rocking and locking subassembly of the invention showing the timer in the "on" position where the motion inducing mechanism is energized.
Figure 6:
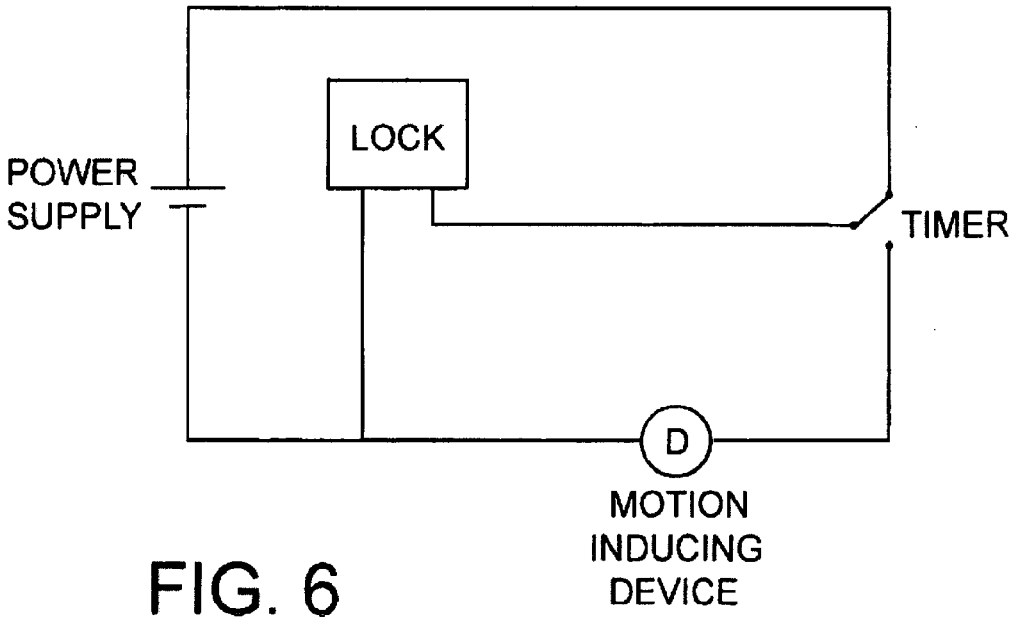
FIG. 6 is a circuit diagram of the embodiment of FIG. 5 showing the timer in the "off" position where the lock device is energized.
Figure 11:
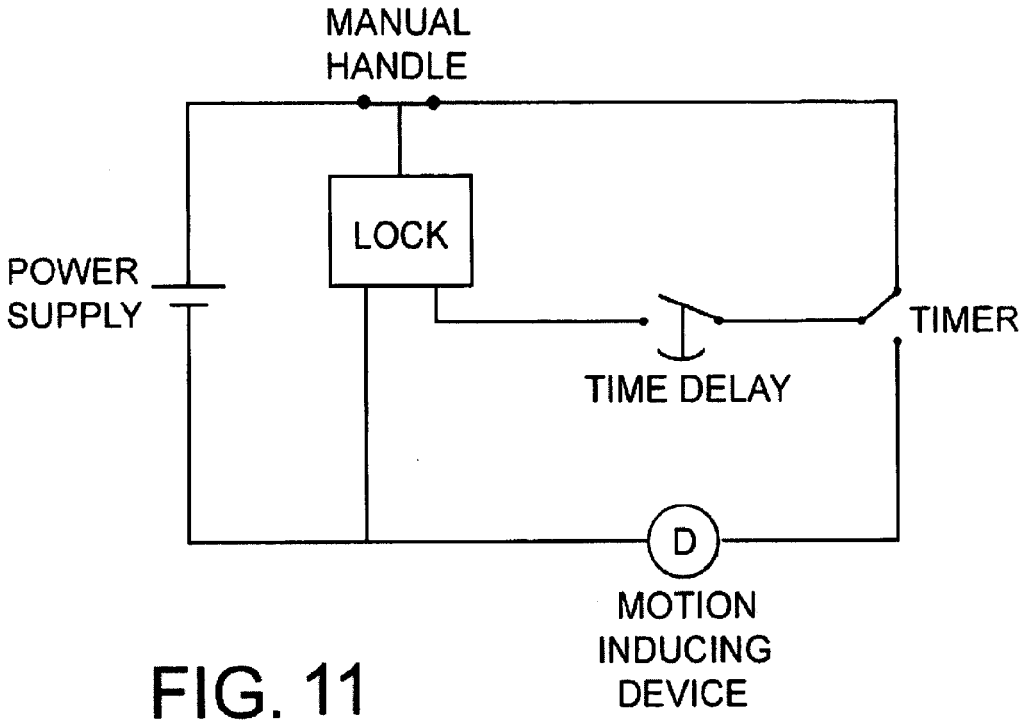
FIG. 11 is a circuit diagram of the embodiment of FIG. 10 showing the manual handle of the lock device in an unlocked or disengaged position to energize the timer.
Figure 12:
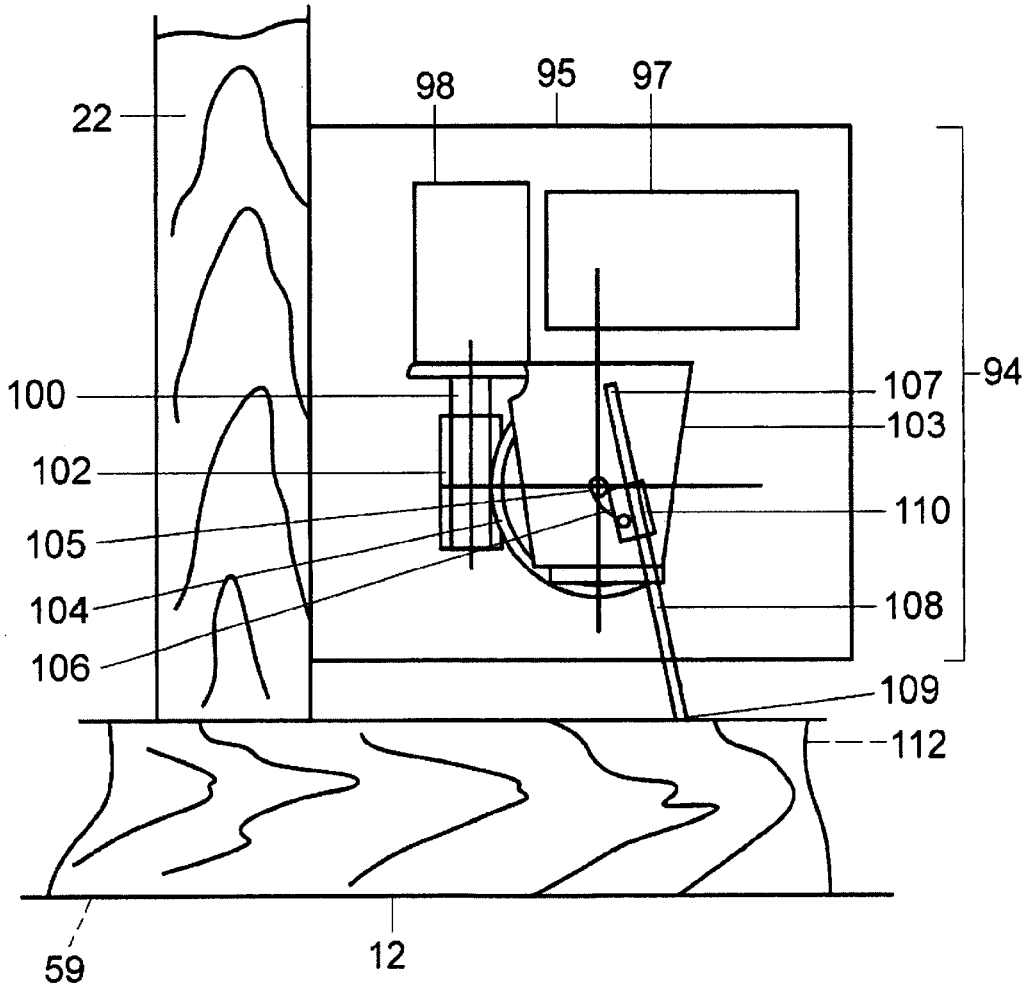
FIG. 12 is a front elevational view of the motion inducing mechanism of the crib rocking mechanism with lock.

As shown in FIGS. 5 and 6, in one crib rocking and locking mechanism of the invention, a timer 97, as shown in FIGS. 11 and 12, for example, is actuatably incorporated into and connected to the motion inducing mechanism 94 and the lock device 96. The timer 97 itself can conventionally either be energized with electricity, or with mechanical means, such as a flat spiral spring or similar clock spring (not shown). The timer 97 is generally set by the user to an "on" position that has a chosen time interval or duration. Although the timer 97 can be chosen and for setting over various maximum time periods, in a preferred embodiment, the timer is settable for a time duration over the range of about one minute to about sixty minutes.

As shown in FIG. 5, when in the "on" position for a set time interval, the timer 97 allows actuating electrical energy to reach and activate the motion inducing device 94 but does not allow energy to reach the lock device 96 for that selected time interval. Thus, while on, the motion inducing device 94 imparts motion to the movable portion 8 relative to the longitudinal base 6. During this on time interval, the lock device 96 is not energized and thus is in an unlocked, or disengaged position. Of course, while in an unlocked or disengaged position, the lock device 96 does not immobilize the movable portion 8 in relation to the longitudinal base 6. After the expiration of the selected time interval, the timer 97, the motion inducing device 94 is no longer energized.

Referring to now FIG. 6, upon expiration of the set time interval, the timer is in its "off" position, where the motion inducing device 94 is de-energized and the motion of the movable portion 8 relative to the base 6 ceases. The lock device 96 now becomes energized, causing the lock device 96 take its engaged or locked position, which immobilizes the movable portion 8 relative to the base 6.

Figure 7:
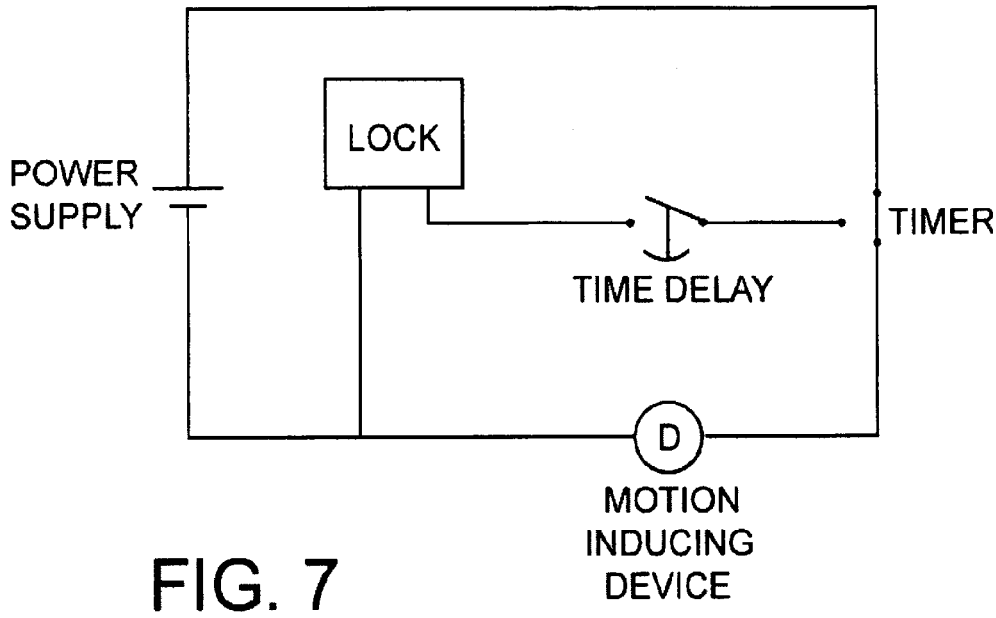
FIG. 7 is a circuit diagram of a second embodiment of a combined rocking and locking subassembly of the invention showing the timer in the "on" position to energize the motion inducing mechanism.
Figure 8:
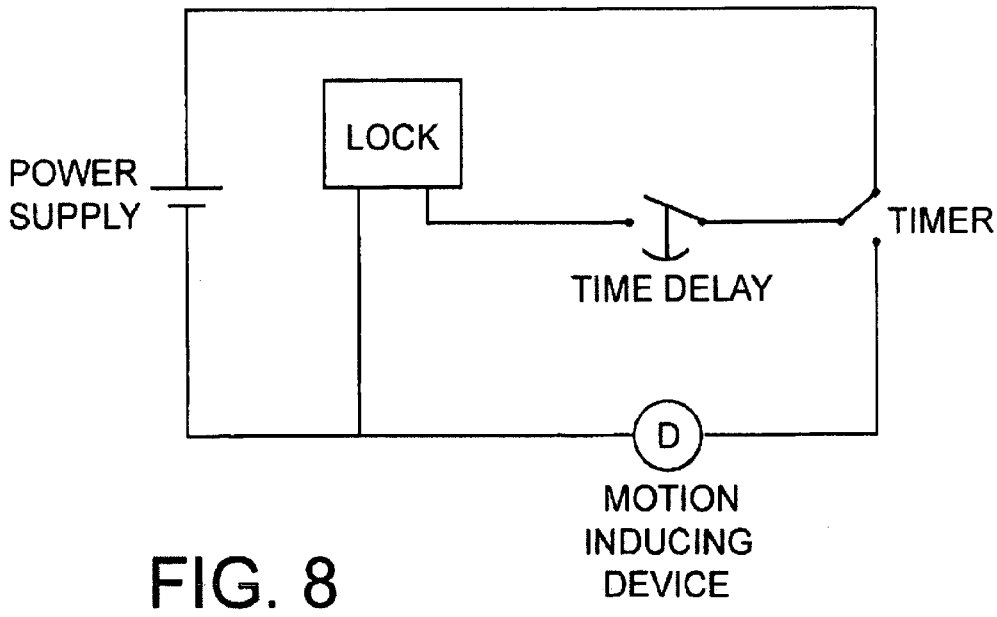
FIG. 8 is a circuit diagram of the embodiment of FIG. 7 showing the timer in the "off" position to energize the time delay switch.
Figure 9:
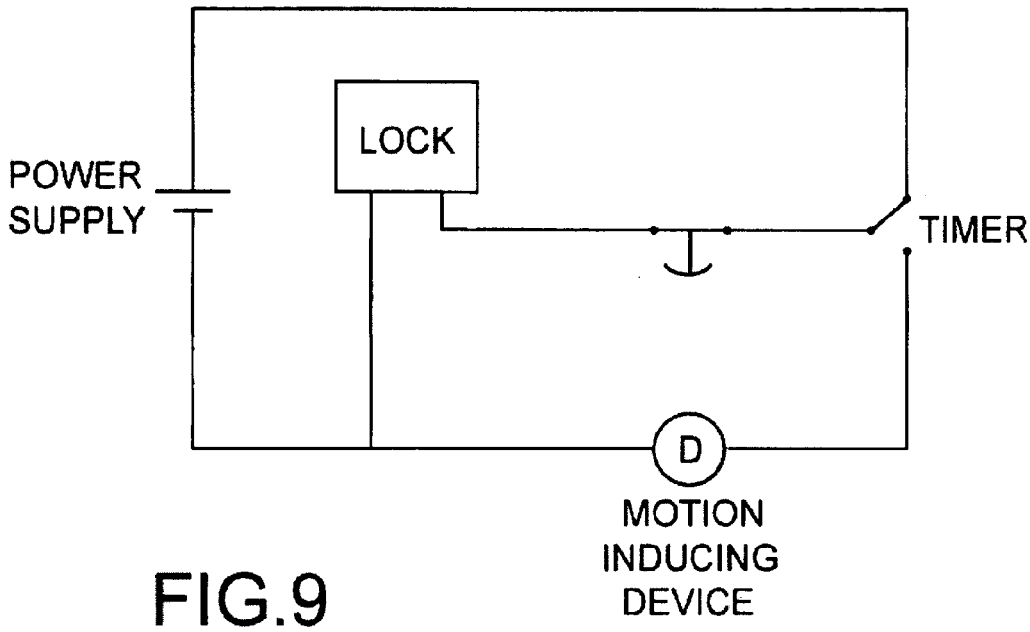
FIG. 9 is a circuit diagram of the embodiment of FIG. 7 showing the time delay switch actuated to energize the lock device.

In an alternative embodiment the inventive motion inducing and locking device 2, as shown schematically in FIGS. 7, 8 and 9, a time delay switch (not detailed) is functionally inserted between the timer 97 and the lock device 96. The time delay switch provides a delay time interval between the instant when the motion inducing mechanism ceases moving (rocking) the movable portion 8 and the instant when the lock device 96 is actuated and engages the moving portion 8, thereby immobilizing the movable portion 8. Such a delay time interval may be desired to compensate for the inertial swinging motion that may occur briefly in the movable portion 8 immediately after de-energization of the motion inducing mechanism 94 has occurred.

The time delay switch, responsive to the timer 97, actuates the lock device 96 after passage of a preset delay time interval that begins after the timer 97 has returned to the "off" position where the motion inducing device 94 is de-energized. FIG. 7 shows the timer 97 in the "on" position, allowing energy to the motion inducing device 8. While in the "on" position, the time delay switch and lock device 96 are de-energized. Once the selected time interval has expired in the timer 97, as shown in FIG. 8, the motion inducing device 94 becomes de-energized and the time delay switch becomes energized. The time delay switch is preset, by the user or the manufacturer, to actuate and thus energize the lock device 96 after passage of the pre-selected delay time has occurred. Although the duration of delay time interval can be for any amount, in the preferred embodiment of the invention, the delay time is set for about twenty seconds. In FIG. 8, the time delay switch has not actuated yet, and the lock remains de-energized. FIG. 9 shows the actuated time delay switch after the delay time has expired, thus allowing energy to the lock device 96 so that the lock device 96 can actuate.

Figure 10:
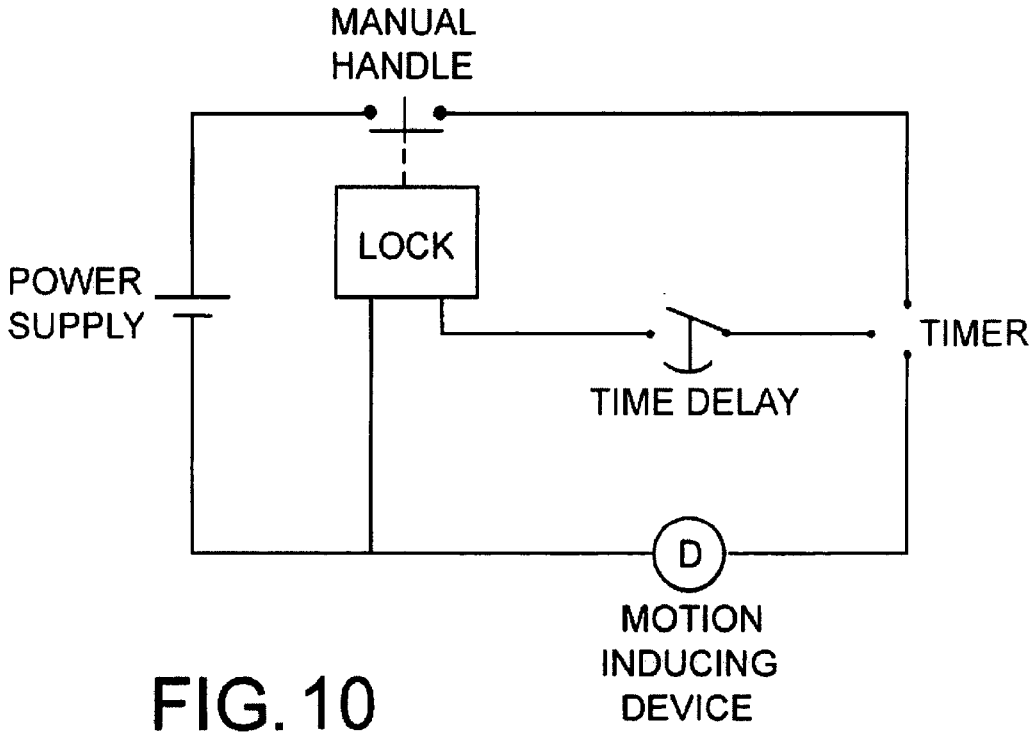
FIG. 10 is a circuit diagram of a third embodiment of a combined rocking and locking subassembly of the invention showing the manually operated handle of the lock device in a locked or engaged position to de-energize the timer and the motion inducing mechanism.
Figure 16:
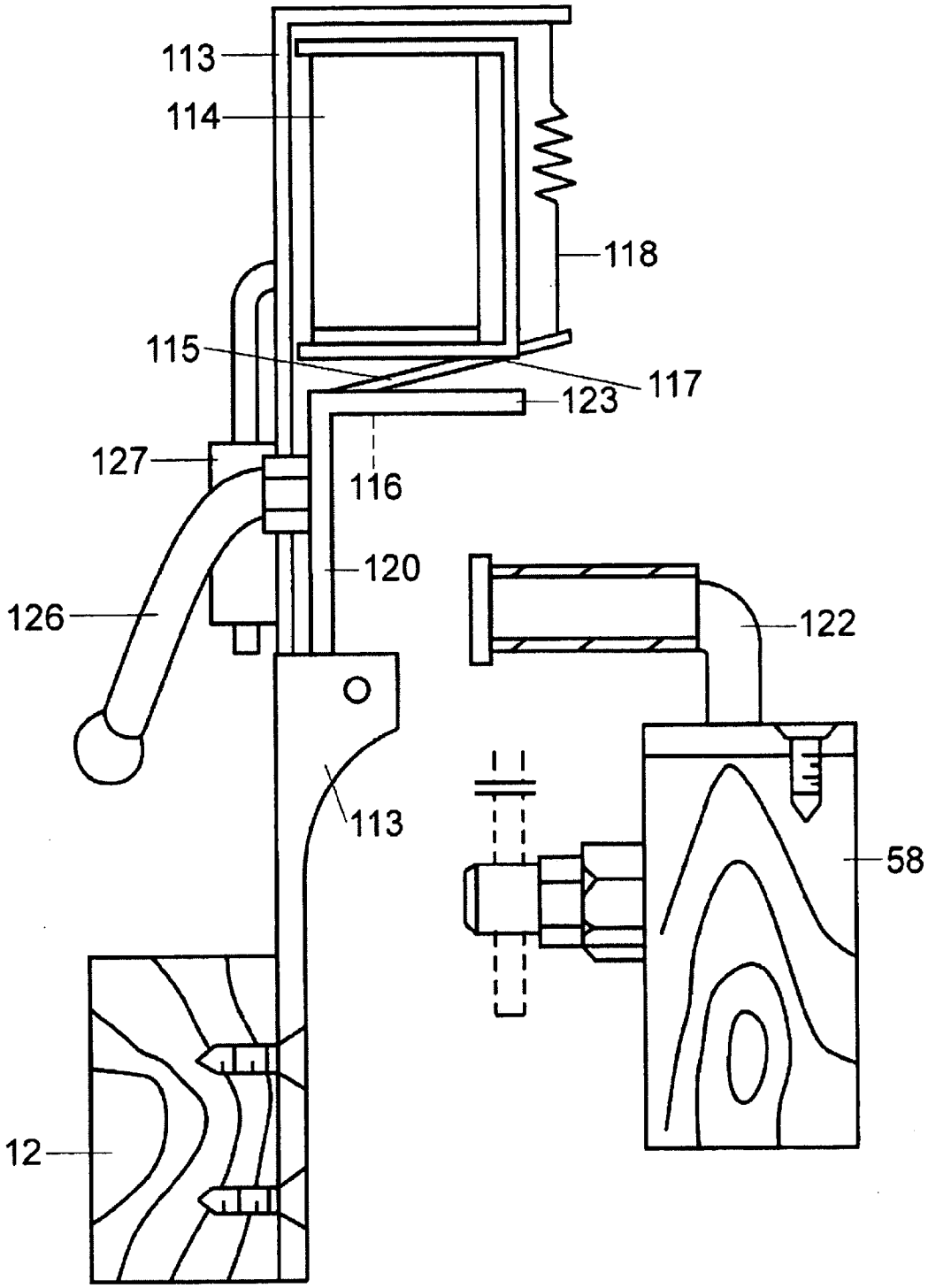
FIG. 16 is a side elevational view of a second embodiment of the lock device showing the lock associated manually operated handle and the fork in a disengaged or unlocked position.

FIGS. 10 and 11 show schematically yet another embodiment of the rocking and locking mechanism of the invention. In this embodiment, a manual handle 126, as shown in FIG. 16, is operably connected to the lock device 96 so as to permit a user to manually engage and disengage the lock device 96. FIG. 10 shows the handle 126 in an engaged position, which both engages the lock device 96 and also de-energizes the timer 97 and motion inducing mechanism 94. When the handle 126 is in a disengaged position, as illustrated schematically in FIG. 11, the lock device 96 disengages and the timer 97 becomes energized for operation.

Figure 13:
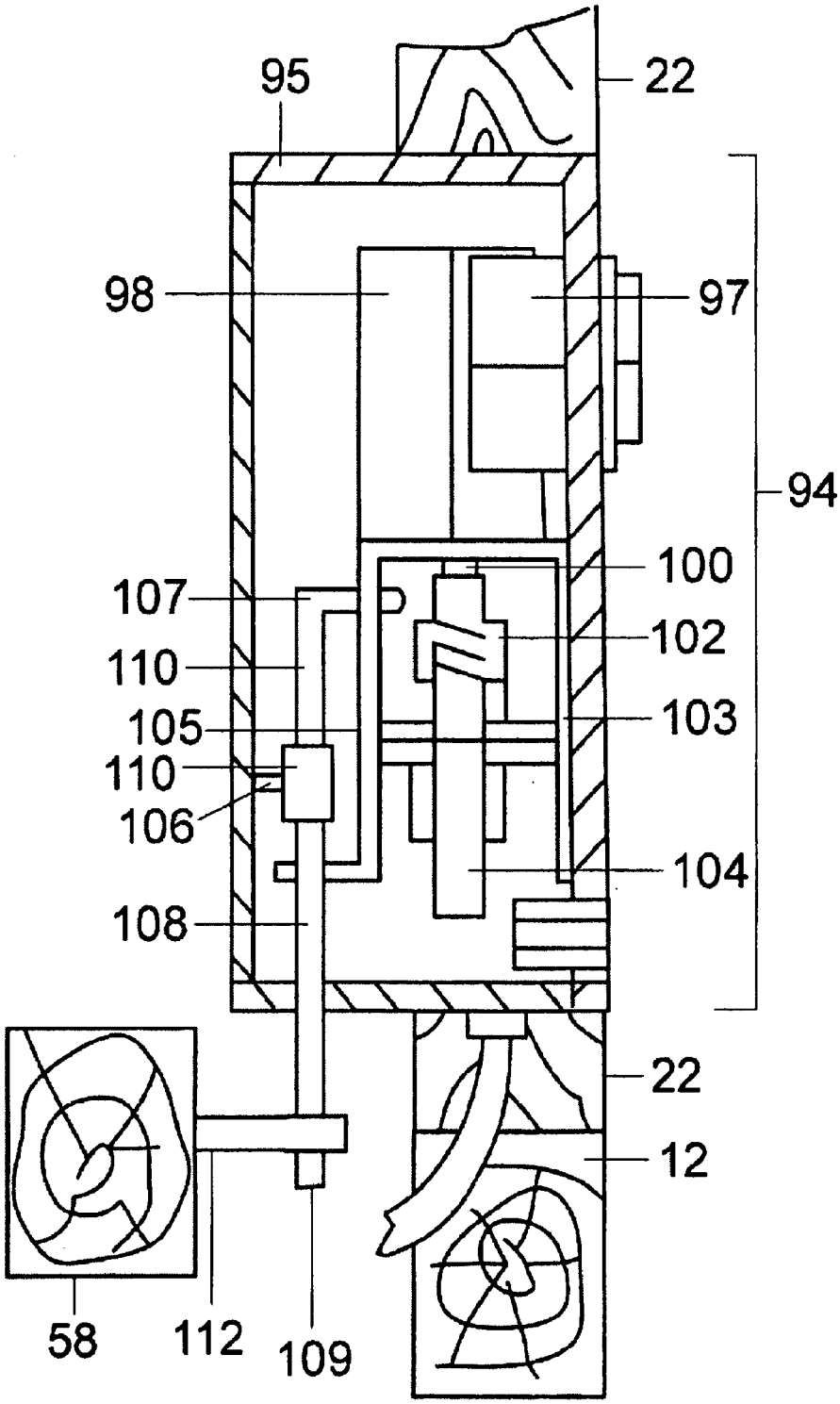
FIG. 13 is a side elevational view of the motion inducing mechanism and locking mechanism.

FIGS. 12 and 13 show more detailed illustrations of the motion inducing mechanism 94, with the timer 97, of the crib rocking and locking mechanism 2. Both the motion inducing mechanism 94 and the timer 97 are generally enclosed within, and affixed to, a housing 95, which in turn, is mounted to vertical base bracket 22 of the longitudinal base 6 using screws, rivets, or other conventional fastening means (not shown). Alternatively, depending upon component locations and interrelationships, housing 95 can be affixed to some other portion of base 6, such as to another brackets 20, 24, 26, 28 or 30, or a base support 12 or 14, or a top supports 32 or 34, or otherwise as desired.

As discussed above, the timer 97 controls the time duration for which the motion inducing mechanism 94 is energized. The motion inducing mechanism 94 as energized through the timer 97 imparts a rocking motion to the movable portion 8 of the cradle assembly 4 through an operable interconnection of the mechanism 94 with the bottom beam 58 of the movable portion 8. It is understood, however, that depending on where housing 95 is affixed to the longitudinal base 6 (see FIGS. 1, 2 and 3 for illustration), the motion inducing mechanism 94 can also be operably connected with bottom beam 60, with top beams 86 or 88, with widthwise extending bottom cross strut members 59 or 61, with widthwise extending top cross strut 90 or 92, with any one of the vertical carriage brackets, 70, 72, 74, 76, 78, 80, 82 or 84, with any hanging links 40, 42, 44 or 46, or otherwise if desired.

In one embodiment of the inventive motion inducing device 94 and lock device 96, as shown in FIGS. 12 and 13, motion inducing mechanism 94 comprises electric motor 98, shaft 100, worm 102, worm gear 104, crank shaft 106, push stick 108, slipper 110 and push target stud 112. All components, except for the push target stud 112 and a portion of the push stick 108, are generally enclosed within the housing 95.

The electric motor 98, controlled by the timer 97 and affixed to housing 95, rotates the drive shaft 100, which, in turn, drives the worm 102 to which the shaft 100 is axially fixed. Also attached to housing 95 is a U-shaped worm gear seat 103. The worm gear seat 103 rotatably houses the worm gear 104, which is in meshed engagement with the worm 102. Fixedly attached to and driven by the worm gear 104 is the crank shaft 106. The crank shaft 106 extends from worm gear 104 axis, located within the seat 103, through a hole 105 defined in the seat 103, and to an area outside of and proximal to an outer surface of the seat 103. The push stick 108 has a first end 107 that is pivotally attached to an adjacent portion of the worm gear seat 103, and also an opposite movable second end 109. The mid or shaft region of the push stick 108 is slidably engaged with a slipper 110, which, in turn is rotatably connected to an end portion of the crank shaft 106. The movable second end 109 of push stick 108 is slidably connected to a push target stud 112 that is rotatably illustratively mounted to the lengthwise bottom beam 58 of movable portion 8.

In operation, after the electric motor 98 is energized by the timer 97, the motor 98 rotates the shaft 100, which, in turn, drives the worm 102. The worm 102 meshingly engages the worm gear 104 to cause it to rotate. Rotating the worm gear 104 drives crank shaft 106, which rotates within the slipper 110. Because crank shaft 106 is offset, it causes the slipper 110 to slide reciprocally along the shaft of the push stick 108. With the first end 107 of the push stick 108 pivotally connected to the worm gear seat 103, the slipper 110 causes the movable second end 109 of push stick 108 to translate linearly, with the second end 109 of the push stick 108 slidably engaging the push target stud 112. Since the push target stud 112 is rotatably connected to the lengthwise bottom beam 58 of the movable portion 8, the push stick 108 causes the movable portion 8 of the crib to translate along an arcuate path, producing rocking of the movable portion 8.

Figure 14:
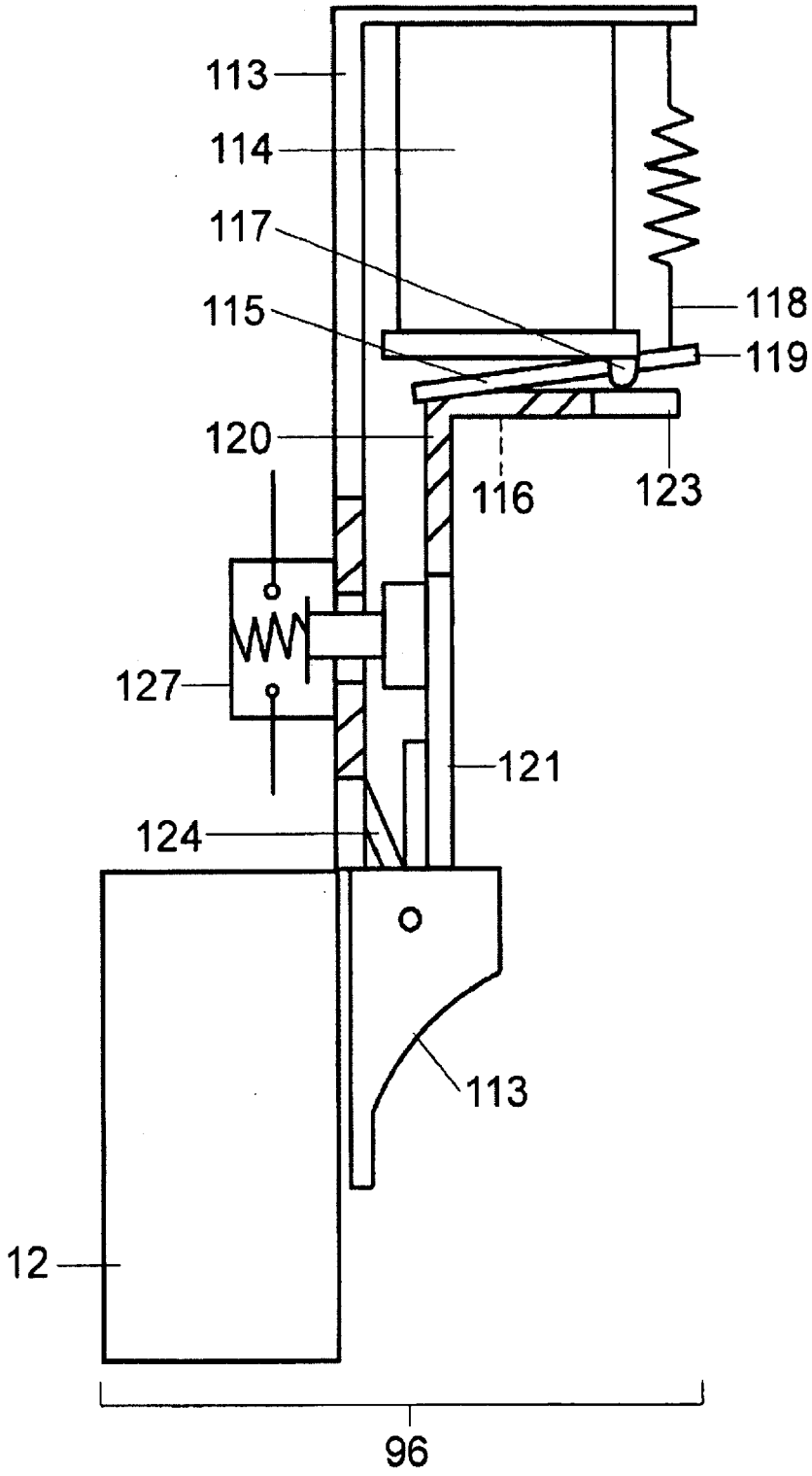
FIG. 14 is a side elevational view of a first embodiment of the lock device showing the fork in a disengaged or unlocked position.
Figure 15:
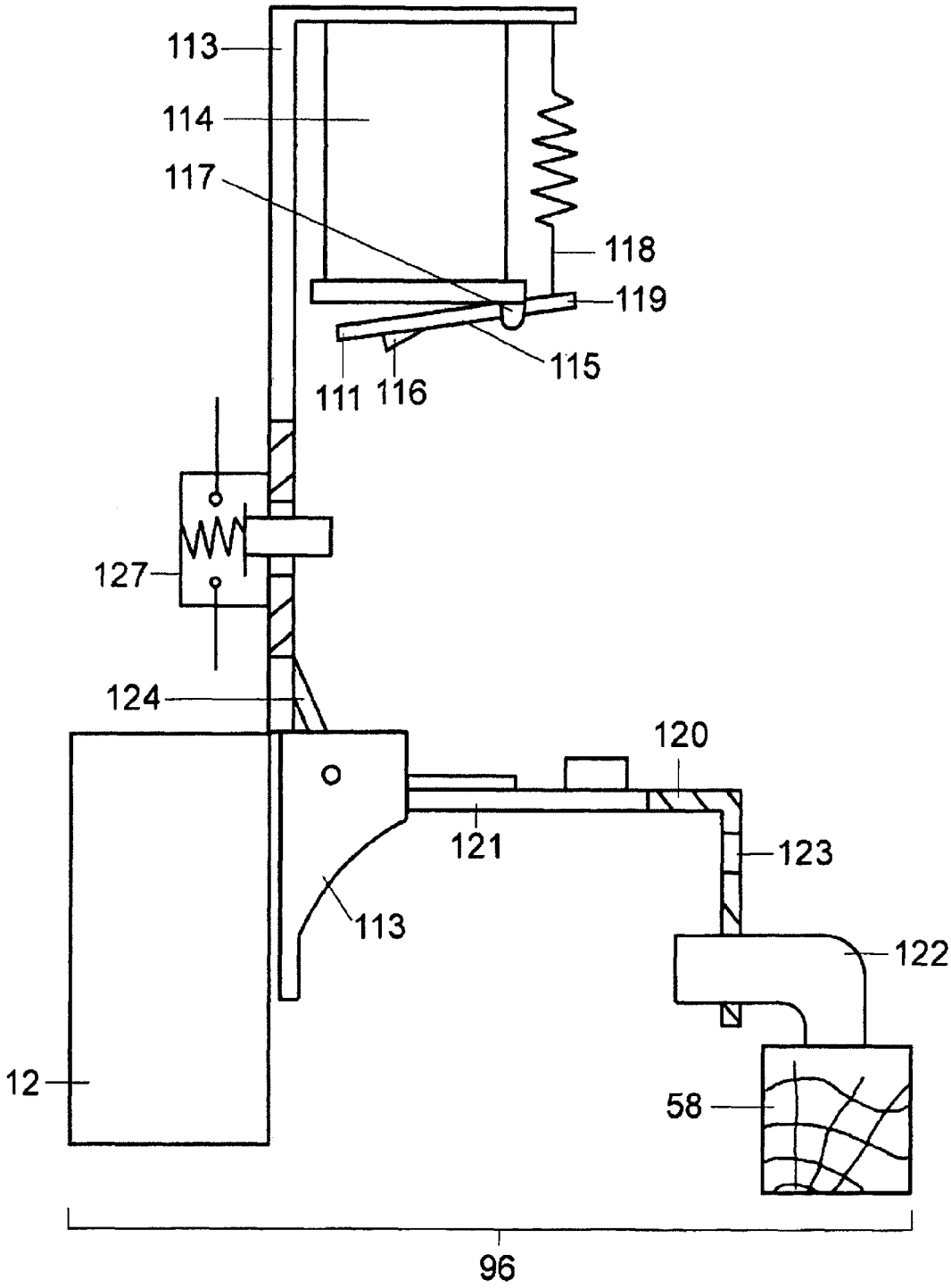
FIG. 15 is a side elevational view of the embodiment of FIG. 14 showing the fork in an engaged or locked position.

FIGS. 14 and 15 show more detailed illustrations of an embodiment of the lock device 96 of the crib rocking and rocking mechanism 2. The lock 96 is generally enclosed within, and affixed to, a lock support 113, which in turn, is mounted to base support 12 of the base 6. Although the lock support 113 of lock device 96 is shown in FIGS. 14 and 15 as being affixed to the base support 12, it is understood that lock support 113 can be affixed to another portion of the apparatus, such as to the vertical brackets 20, 22, 24, 26, 28 or 30, the other base support 14, or top supports 32 or 34, or otherwise, if desired.

As discussed above, lock device 96 is energized through the timer 97 or delay switch (not shown) to immobilize the movable portion 8 of the rocking crib or cradle 4 in relation to the longitudinal base 6 through an operable connection of the lock device 96 with bottom beam 58. It is understood, however, that depending on where the lock device 96 is associated with the base 6 (see FIGS. 1, 2 and 3 for illustration), the lock device 96 can also have an operable connection with bottom beam 60, either of lengthwise top beams 86 or 88, either of widthwise bottom cross strut members 59 or 61, either of widthwise top cross strut members 90 or 92, any of the vertical carriage brackets, 70, 72, 74, 76, 78, 80, 82 or 84, any of hanging links 40, 42, 44 or 46, or otherwise if desired.

In one embodiment of the invention as shown in FIGS. 14 and 15, lock device 96 is comprised of electromagnetic coil 114, contact magnet lever 115, contact magnet 116, return spring 118, fork 120, bias spring 124 and lock target stud 122 and lock switch 127. All components, except for lock target stud 122, are generally enclosed within the lock support 113.

The contact magnet lever 115 is pivotally connected to the lock support 113 at the pivot 117. The second end 119 of the contact magnet lever 115 which is located opposite the first end 111, is connected in tension to return spring 118 with the other end of spring 118 being connected to a portion of the lock support 113. The electromagnetic coil 114, as affixed to the lock support 113, and positioned to draw upwardly upon a first end 111 of the contact magnet lever 115 when energized by the timer of delay switch (not shown). Thus, until energized electromagnetic coil 114 draws upwardly upon first end 111 of contact magnet lever 115, the magnet 116 located adjacent the first end 11 of lever 115 is biased outwardly away from electromagnetic coil 114 due to the tension exerted on second end 119 by return spring 118.

Hingedly attached to lock support 113 is a first end portion 121 of fork 120. Located between lock support 113 and the first end portion 121 of fork 120 is a flattened bias spring 124 that is held by lock support 113. Opposite the first end 121 of the fork 120 is a segment 123 that extends perpendicularly outwardly from the fork 120. Operably engageable with a mid-region of the fork 120 is a lock switch 127. The lock switch 127 is functionally connected to the timer 97 (not shown) so that it can energize and de-energize the timer as indicated in the above circuit discussion.

As illustrated in FIG. 14, when in the unlocked or disengaged position from lock target stud 122, fork 120 is oriented vertically, with perpendicular segment 123 of fork 120 in magnetic engagement with the contact magnet 116. When in this unlocked position, fork 120 mid-region is in contact with switch 127, which then is in a closed configuration that allows timer 97 to be energized. Fork 120 is spring biased in a horizontal or "lock" direction when perpendicular segment 123 is in magnetic contact with contact magnet 116. As illustrated in FIG. 15, when in the locked or engaged position, fork 120 is pivoted and hingedly displaced approximately 90 degrees from vertical (oriented horizontally) so that perpendicular segment 123 is in resistive engagement with the lock target stud 122, where the fork 120 defined in the segment 23 straddles the lock target stud 122. The stud 122 is fixedly mounted to the lengthwise bottom beam 58 of the movable portion 8. When in the locked position, the fork 120 is no longer in operable contact with the lock switch 127, causing the switch 127 to thereby de-energize the timer 97 and the motion inducing mechanism 94.

In operation, fork 120 is initially in an unlocked or disengaged position from lock target stud 122 with perpendicular segment 123 in magnetic contact with the contact magnet 116. Magnetic contact is maintained between the perpendicular fork segment 123 and the contact magnet 116 by return spring 118. When the timer 97 or delay switch (if present) energizes the electromagnetic coil 114, contact magnet 116 is drawn upwardly and away from the perpendicular segment 123 of the fork 120. Bias spring 124 then forces fork 120 to hingedly move from a vertical to a horizontal position, causing perpendicular fork 120 to disengage from switch 127 to de-energize the timer and motion inducing mechanism, and further causing segment 123 to resistively engage lock target stud 122. Since the lock target stud 122 is fixedly connected to the lengthwise bottom beam 58 of the movable portion 8 lock device 96 immobilizes the movable portion 8 relative to the longitudinal base 6.

FIG. 16 shows another embodiment of lock device 96. The lock device 96 illustrated in FIG. 16 is essentially identical to that shown in FIGS. 14 and 15 except that the lock device 96 in FIG. 16 includes the handle 126 fixedly attached to the fork 120. Handle 126 can be grasped by a user to manually rotate the fork 120 and the perpendicular segment 123 so that the fork 120 is moved (pivoted) from a locked or engaged position with the lock target stud 122 to an unlocked or disengaged position that is apart from lock target stud 122 and is in contact with both the contact magnet 116 and lock switch 127. If desired, the handle 126 can also be used to rotate the fork 120 and the perpendicular segment 123 so that the fork 120 is moved to a locked or engaged position with the lock target stud 122. When the handle 126 is used to move the fork 120 to a locked or unlocked position, lock switch 127 de-energizes or energizes the timer 97 and motion inducing mechanism 94, accordingly.

In operation of one preferred embodiment of the invention, the lock fork 120 is in the unlocked position and the timer 97 is set to an "on" position for a time duration or interval in the range of from about one minute to about sixty minutes. When the timer 97 is set, the motor 98 of the motion inducing mechanism 94 is energized, rotating the shaft 100 and driving the worm 102. Worm 102 meshingly engages worm gear 104, causing it to rotate and drive the crank shaft 106. Rotating the crank shaft 106 causes the slipper 110 to slide up and down the shaft of the push stick 108, causing the movable second end 109 of push stick 108 to translate linearly. With the second end 109 of push stick 108 slidably engaging the push target stud 112, the push stick 108 causes the movable portion 8 of the crib to translate and rock through an arcuate path reciprocatingly.

Upon an expiration of the set time duration interval of the timer 97, the timer 97 moves to an "off" position, causing the motor 98 and related components of the motion inducing device 94 to become de-energized and concurrently causing the electromagnetic coil 114 of the lock 96 to become energized, drawing contact magnet 116 upwardly and away from the perpendicular segment 123 of the fork 120. Bias spring 124 then forces fork 120 to hingedly move from a vertical to a horizontal position, causing perpendicular fork 120 to disengage from switch 127 to de-energize both the timer 97 and motion inducing mechanism 94, and further causing segment 123 to resistively engage lock target stud 122. Since the lock target stud 122 is fixedly connected to the lengthwise bottom beam 58 of the movable portion 8 of the crib, lock device 96 immobilizes the movable portion 8 in relation to the longitudinal base 6.

In operation of another preferred embodiment of the invention, lock fork 120 is in the unlocked position and the timer 97 is set to an "on" position for a time duration that is preferably in the range of from about one minute to about sixty minutes. Upon setting the timer 97, the motor 98 of the motion inducing mechanism 94 is energized, rotating shaft 100 and driving worm 102. Worm 102 meshingly engages worm gear 104, causing it to rotate and drive drives crank shaft 106. Rotating crank shaft 106 causes slipper 110 to slide up and down the shaft of push stick 108, causing the movable second end 109 of push stick 108 to translate linearly. With the second end 109 of push stick 108 slidably engaging the push target stud 112, the push stick 108 causes the movable portion 8 of the crib to rock.

Upon an expiration of the time duration of the timer 97, the timer moves to an "off" position, causing the motor 98 and related components of the motion inducing device 94 to become de-energized, and further causing the time delay switch (not shown) to become energized. While in an energized position, the preset delay time of about twenty seconds of the delay switch begins while any inertial rocking movement of the movable portion 8 of the rocking crib or cradle 4 subsides. After the delay time of about twenty seconds is expended and the inertial movement of the movable portion 8 has substantially subsided, the delay switch actuates, energizing the electromagnetic coil 114 of the lock 96.

When the delay switch energizes the electromagnetic coil 114, thus drawing contact magnet 116 upwardly and away from the perpendicular segment 123 of the fork 120. Bias spring 124 then forces fork 120 to hingedly move from a vertical to a horizontal position, causing perpendicular fork 120 to disengage from switch 127 to de-energize both the timer 97 and motion inducing mechanism 94, and further causing segment 123 to resistively engage lock target stud 122. Since the lock target stud 122 is fixedly connected to the lengthwise bottom beam 58 of the movable portion 8 of the crib, lock 96 immobilizes the movable portion 8 in relation to the longitudinal base 6.

In operation of another preferred embodiment of the invention, the handle 126 (FIG. 16) of the lock device 96 is grasped by a user to manually rotate the fork 120 and perpendicular segment 123 from a locked or engaged position with the lock target stud 122 to an unlocked or disengaged position in contact with both the contact magnet 116 and lock switch 127. When in the unlocked position, the lock fork 120 is in operable contact with the lock switch 127, allowing the timer 97 to become energized and set by the user, as in the procedures described above, thereby to energize the motion inducing mechanism 94.

In another operation of this embodiment, the handle 126 is grasped by the user to rotate the fork 120 and perpendicular segment 123 from a position of contact with the contact magnet 116 and lock switch 127 to a locked or engaged with the lock target stud 122. This movement causes the fork 120 to disengage from the lock switch 127, thus de-energizing the timer 97 and the motion inducing mechanism 94. This operation may be desirable when one wishes to interrupt the timed movement interval of the energized motion inducing mechanism 94 and the moving movable portion 8 of the cradle assembly 4.

The invention disclosed herein can be embodied in many different forms. Shown in the drawings and described herein in detail are presently preferred embodiments of the invention. It is to be understood, however, that the present disclosure provides exemplifications of the principles of the invention and that the disclosure does not limit the invention to the disclosed and illustrated embodiments.

What is claimed is:

1. A cradle assembly comprising:

a stationary base frame;

rocking frame movably mounted to said base frame;

motion inducing subassembly fixed to said base frame and operably engageable with said rocking frame for inducing rocking motion of said rocking frame when said subassembly is energized;

a user settable timer connected operatively to said subassembly for energizing said subassembly for a predetermined time interval; and a lock device fixed to said base frame and functionally connected to said timer, said device being actuated when said time interval has expired, said device when so actuated being connected with said rocking frame and thereby preventing said motion of said rocking frame.

2. The cradle assembly of claim 1 which additionally has a cradle that rests upon said rocking frame.

3. A rocking cradle with lock comprising in combination:

a base frame, a crib platform with pivotable linkage means for supporting and oscillatorily suspending said crib platform relative to said base frame whereby said crib platform is reciprocatorily rockable relative to said base frame;

a drive for so reciprocatorily rocking said crib platform, said drive comprising a motor, gear reduction means associated with said motor, a crank shaft driven by said gear reduction means, and push stick means connected to said crank shaft whereby said crib platform is so reciprocatorily rockable by said drive;

a lock for preventing rocking movement of said crib platform, said lock comprising a lock fork having a ferromagnetic portion, a proximal end portion that is pivotably associated with said base frame, and a distal end portion that is forked and that is engageable with a portion of said crib platform whereby, when said distal forked end is so engaged with said crib platform, said crib platform cannot so reciprocatorily rock;

electromagnetic means for holding said ferromagnetic portion and for retaining said distal forked end in disengaged relationship relative to said crib platform when said electromagnetic means is actuated; and power switch means, including timer means, for energizing and denergizing said motor and for energizing said electromagnetic means when said motor is denergized.

4. A rocking crib with lock comprising in combination:

a base frame with upstanding opposite side portions;

a crib platform adjacent to said opposite side portions;

linkage members for supporting and oscillatorily suspending said crib platform relative to said opposite side portions whereby said crib platform is reciprocatorily rockable relative to said base frame;

a drive for so reciprocatorily rocking said crib platform, said drive comprising a motor mounted on said base frame;

a worm gear driven by said motor and connected with a worm gear;

a crank shaft driven by said worm gear; and a push stick with slipper means that is connected with said crank shaft and that rotates with said crank shaft whereby once during each rotation of said crank shaft, said push stick associates with said crib platform whereby said crib platform is so reciprocatorily rocked;

a lock for preventing rocking movement of said crib platform when said motor is not operating, said lock comprising:

a lock fork having a ferromagnetic portion, proximal end portion that is pivotably associated with said base frame, and a distal end portion that is forked and that is engageable with a portion of said crib platform whereby, when said distal forked end is so engaged with said crib platform, said crib platform cannot so reciprocatorily rock;

electromagnetic means for holding said ferromagnetic portion and for retaining said distal forked end in disengaged relationship relative to said crib platform when said electromagnetic means is actuated; and power switch means, including timer means for energizing said motor for a predetermined period, and for de-energizing said electromagnetic means when said motor is de-energized.

5. A rocking cradle having an automatic motion-lock comprising:

a longitudinal base;

a cradle portion movably connected to the base;

a housing mounted to the base;

a motion inducing mechanism attached to the housing, said mechanism operably inducing a movement of the cradle portion when energized;

a timer in operative association with the motion inducing mechanism, said timer controlling a time duration during which the motion inducing mechanism is energized;

a delay switch in obedience to the timer, said switch becoming energized when the time duration for the motion inducing mechanism is expended, the delay switch becoming triggered after a preselected delay time has passed after energization of the switch;

a locking mechanism actuatingly associated with the delay switch, said locking mechanism immobilizing the cradle portion in relation to the longitudinal base when the delay switch is triggered; and a locking handle operably connected to the locking mechanism, said handle movable to manually engage and disengage the locking mechanism, the handle causing a de-energization of the timer and motion inducing mechanism when engaging the locking mechanism.

6. The rocking cradle of claim 5 wherein the motion inducing mechanism comprises:

an electric motor attached to the housing and having a shaft;

a worm fixedly connected to the shaft and driven by the motor;

a worm gear rotatingly attached to the housing and in meshing relation with the worm; and a push stick in operable engagement with the worm gear, said push stick movably connected to the cradle portion.

7. The rocking cradle of 6 wherein the operable engagement of the push stick with the worm gear comprises:

a crankshaft driven by the worm gear;

a slipper rotatingly connected to the crankshaft and in sliding engagement with the push stick, the push stick having a first end and a second end with the first end movably connected to the housing; and a push target stud rotatingly attached to the cradle portion, the push target stud in sliding engagement with the second end of the push stick.

8. The rocking cradle of claim 5 wherein the locking mechanism comprises:

a lock support attached to the longitudinal base;

an electromagnetic coil mounted to the support and having a contact magnet, the coil actuatingly associated with the delay switch;

a fork movably attached to the support and in operable engagement with the contact magnet when in an unlocked position, said fork being spring-biased in a locking direction and fixedly attached to the locking handle; and a lock target stud attached to the cradle portion of the rocking cradle for engagement with the lock fork when the lock fork is in a locked position.

9. The rocking cradle of claim 5 wherein the movable connection between the cradle portion and the longitudinal base comprises a four-link connection.

10. The rocking cradle of claim 5 wherein the induced movement of the cradle portion is a swinging motion longitudinally parallel with the longitudinal base.

11. The rocking cradle of claim 5 wherein the induced movement is cyclic.

12. The rocking cradle of claim 5 wherein the timer can be set to between about 1 minute and 60 minutes.

13. The rocking cradle of claim 5 wherein the preselected delay time of the delay switch is about 20 seconds.

14. A method for moving and thereafter immobilizing a movable portion of a rocking cradle, the method comprising:

energizing a motion inducing mechanism, the motion inducing mechanism providing movement to the movable portion of the rocking cradle;

controlling a time duration of the motion inducing mechanism with a timer so that the movement of the movable portion of the rocking cradle stops after a preset time expires;

energizing a delay relay upon an expiration of the time duration of the motion inducing mechanism, the delay relay activating a switch after a preset delay time of the delay relay has been expended; and triggering a locking device with the activated switch of the delay relay to cause the movable portion of the rocking cradle to become immobilized in relation to a stationary, longitudinal base of the rocking cradle.

15. A lock device for locking a rockable cradle comprising in combination:

a lock fork having a ferromagnetic portion, proximal end portion that is pivotably associated with a base frame, and a distal end portion that is forked and that is engageable with a portion of said rockable cradle whereby, when said distal forked end is so engaged with said cradle, said cradle cannot rock;

electromagnetic means for holding said ferromagnetic portion and for retaining said distal forked end in disengaged relationship relative to said crib platform when said electromagnetic means is actuated; and power switch means, including timer means for energizing said motor for a predetermined period, and for de-energizing said electromagnetic means when said motor is de-energized.

* * * * *